US006332907B1

(12) United States Patent
Brungs

(10) Patent No.: US 6,332,907 B1
(45) Date of Patent: Dec. 25, 2001

(54) ALLOY FOR PRODUCING METAL FOAMED BODIES USING A POWDER WITH NUCLEATING ADDITIVES

(75) Inventor: Dieter Brungs, Meschede (DE)

(73) Assignee: Honsel GmbH & Co. KG, Meschede (DE)

( * ) Notice: Subject to any disclaimer, the term of this patent is extended or adjusted under 35 U.S.C. 154(b) by 0 days.

(21) Appl. No.: 09/486,454

(22) PCT Filed: Aug. 8, 1998

(86) PCT No.: PCT/EP98/05036

§ 371 Date: Feb. 25, 2000

§ 102(e) Date: Feb. 25, 2000

(87) PCT Pub. No.: WO99/11832

PCT Pub. Date: Mar. 11, 1999

(30) Foreign Application Priority Data

Aug. 30, 1997 (DE) ..... 197 37 957
Mar. 13, 1998 (DE) ..... 198 10 979

(51) Int. Cl.[7] ..... B22F 3/10
(52) U.S. Cl. ..... 75/255; 419/2
(58) Field of Search ..... 75/255; 419/2

(56) References Cited

U.S. PATENT DOCUMENTS 3,087,807 4/1963 Allen et al. .
4,969,428 * 11/1990 Donahue et al. ..... 123/195 R
5,112,697 * 5/1992 Jin et al. ..... 428/613
5,151,246 9/1992 Baumeister et al. ..... 419/2

FOREIGN PATENT DOCUMENTS 2362293 6/1975 (DE) .
4018360 5/1991 (DE) .
4340791 5/1995 (DE) .
19651197 6/1997 (DE) .
91/01387 2/1991 (WO) .
92/03582 3/1992 (WO) .

* cited by examiner

*Primary Examiner*—Daniel J. Jenkins
(74) *Attorney, Agent, or Firm*—Ostrolenk, Faber, Gerb & Soffen, LLP

(57) ABSTRACT

The invention provides a metal alloy made from a metal matrix with added nucleating particles which causes uniform formation of bubbles and a homogenous foam structure. The invention also provides a method for producing metal foamed bodies including the following steps: producing a homogeneous mixture of at least one metal powder forming a metal matrix, a powder made of or made with nucleating particles causing uniform formation of bubbles and a homogenous foam structure, and at least one gas-generating gasifying agent powder; introducing the mixture into a mold or compacting the mixture under pressure, e.g., by cold or hot isostatic pressing, followed by hot forming, e.g., by extrusion or rolling, and optional further processing, e.g., by cold forming and/or machining; foaming by heating to a temperature above the temperature of decomposition of the gasifying agent, preferably inside the temperature range of the melting point of the metal used; and subsequent cooling of the body thus foamed. The invention also includes the use of a powder made of or with nucleating particles causing uniform formation of bubbles and a homogenous foam structure as an additive to a mixture consisting of at least one metal powder forming a metal matrix and at least one gas-generating gasifying agent powder in the production of metal foamed bodies.

11 Claims, 2 Drawing Sheets

V = 610x

V=610x

ALLOY FOR PRODUCING METAL FOAMED BODIES USING A POWDER WITH NUCLEATING ADDITIVES

This application is a 371 of PCT/EP98/05036, filed on Aug. 8, 1998, which claims priority to German Application Nos. 197 37 795.5, filed on Aug. 30, 1997 and 198 10 979.2, filed on Mar. 13, 1998.

BACKGROUND OF THE INVENTION

1. Field of the Invention

The invention relates to an alloy for producing metal foamed bodies, a process for producing the alloy with certain additives for the production of metal foamed bodies.

2. Description of the Related Art

Various processes for producing metal foamed bodies are known and consist essentially in adding a gas-producing expanding agent to an alloy powder or a powder mixture comprising alloying constituents, with an unfoamed semifinished product being produced first, after which this semifinished product is foamed by being heated to a temperature above the decomposition temperature of the expanding agent, preferably in the temperature range of the melting point of the metal alloy, after which the body which has been foamed in this way is then cooled. The foaming of the semifinished product may take place freely or inside a die, and if aluminum or aluminum alloys are used, it is possible to produce metal foamed bodies with a density of approximately 0.3 to 1.7 g/cm$^3$.

A process for producing porous metal bodies is described, for example, in DE-40 18 360 C1 and comprises the following steps: producing a mixture from at least one metal powder and at least one gas-producing expanding agent powder, hot compacting of this mixture to form a semifinished product at a temperature at which the metal powder particles are joined predominantly by diffusion and at a pressure which is sufficiently high to prevent decomposition of the expanding agent, in such a manner that the metal particles are joined fixedly to one another and form a gastight barrier for the gas particles from the expanding agent, heating the semifinished product produced in this way to a temperature above the decomposition temperature of the expanding agent, preferably in the temperature range of the melting point of the metal used, followed by cooling of the body which has been foamed in this way.

If pure aluminum powder with an addition of 0.1% by weight of titanium hydride powder was used, it was possible to produce a porous metal body with a density of approximately 0.78 g/cm$^3$. The typical pore size had a diameter of around 1 mm. When using a fully alloyed powder comprising an aluminum alloy with an alloying fraction of 4% by weight magnesium and 0.4% by weight titanium hydride powder, a density of 0.62 g/cm$^3$ with a typical pore size of approx. 2 to 3 mm was achieved.

A drawback of this known process and other processes, for example that which corresponds to U. S. Pat. No. 3,087,807 A, is that the bubble formation during foaming and therefore the structure of the metal foamed body is extremely uneven. This has undesirable effects on the mechanical properties, and consequently it has already been attempted to produce a uniform foam structure by changing the alloy composition or the way in which the process is carried out. However, these The uneven foam structure can be ascribed to uneven nucleation for the bubble formation owing to the uneven size and distribution of the silicon particles. The microstructure of an extruded section which was produced from an AlMgSi powder mixture containing 10% silicon powder is shown in FIG. 1. The silicon particles in the matrix microstructure are unevenly distributed, and their shape and size are also highly irregular.

SUMMARY OF THE INVENTION

The invention is therefore based on the problem, for the production of a foamable metal alloy, in particular an aluminum alloy, of producing a foam structure which is as uniform as possible, in order to achieve the desired properties, and of achieving the best possible strength properties.

The invention provides a metal alloy made from a metal matrix with added nucleating particles which causes uniform formation of bubbles and a homogenous foam structure. The invention also provides a method for producing metal foamed bodies including the following steps: producing a homogeneous mixture of at least one metal powder forming a metal matrix, a powder made of or made with nucleating particles causing uniform formation of bubbles and a homogenous foam structure, and at least one gas-generating gasifying agent powder; introducing the mixture into a mold or compacting the mixture under pressure, e.g., by cold or hot isostatic pressing, followed by hot forming, e.g., by extrusion or rolling, and optional further processing, e.g., by cold forming and/or machining; foaming by heating to a temperature above the temperature of decomposition of the gasifying agent, preferably within the temperature range of the melting point of the metal used; and subsequent cooling of the body thus foamed. The invention also includes the use of a powder made of or with nucleating particles causing uniform formation of bubbles and a homogenous foam structure as an additive to a mixture consisting of at least one metal powder forming a metal matrix and at least one gas-generating gasifying agent powder in the production of metal foamed bodies.

DETAILED DESCRIPTION OF THE PREFERRED EMBODIMENTS

The present invention provides a powder mixture for producing aluminum metal foamed bodies, which mixture, according to the invention, consists of a powder comprising an aluminum alloy, a powder comprising or containing nucleating particles which bring about a uniform bubble formation and homogenous foam structure and have a particle size smaller than 30 $\mu$m, and a gas-producing expanding agent powder, an addition of uniformly distributed silicon, silicon carbide, aluminum oxide and/or titanium boride particles preferably being added for nucleation.

Figure 2:
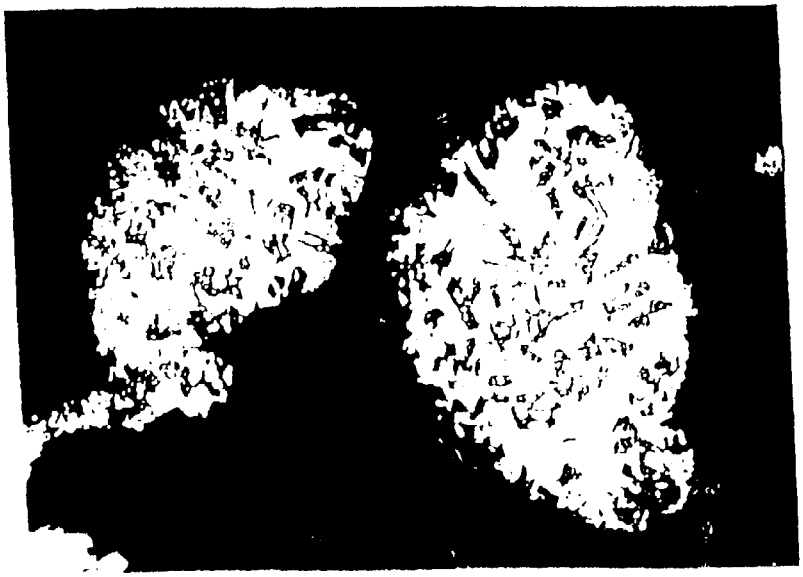
FIG. 2 shows the microstructure of an alloy having uniformly distributed silicon particles formed from hypereutectic AlSi molten materials in accordance with the present invention.

Small, uniformly distributed silicon particles which are formed when hypereutectic AlSi molten materials with up to about 50% silicon in the individual powder grains are atomized are particularly advantageous (FIG. 2). The production process is described in patent application 198 01 941.6, filed by the same applicant, relating to a wear-resistant aluminum alloy, in particular for the production of cylinder liners.

Figure 3:
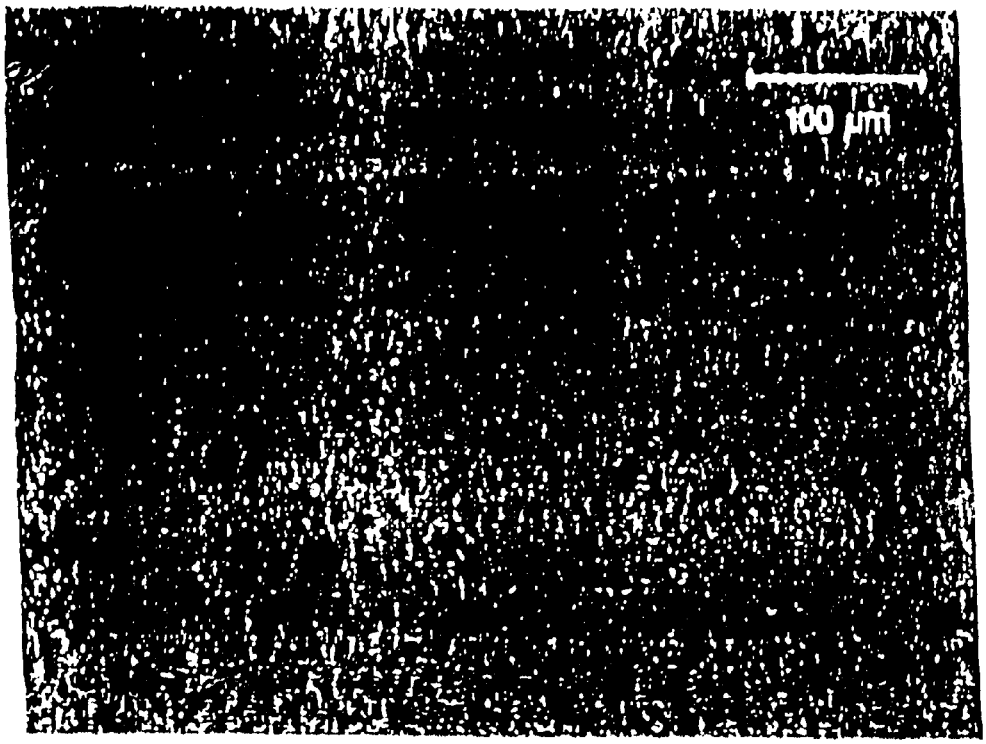
FIG. 3 shows the microstructure of an alloy having uniformly sized and uniformly distributed silicon particles produced from an AlMgSi powder mixture in accordance with the present invention.

The microstructure of an extruded section which was produced from an AlMgSi powder mixture with 10% added silicon in the form of the powder grains described above is shown in FIG. 3. The silicon particles are of a uniform size of between about 10–30 $\mu$m and are uniformly distributed in the matrix.

To solve the abovementioned problem, the invention also proposes a process for producing metal foamed bodies from the abovementioned powder mixture comprising the following steps: producing a homogeneous mixture from at least one metal powder which forms a metal matrix, a powder comprising or containing nucleating particles which bring about a uniform bubble formation and homogeneous foam structure, and at least one gas-producing expanding agent powder, placing the mixture into a die, if appropriate compacting under pressure, e.g. by cold or hot isostatic pressing, subsequently hot-forming, e.g. by extrusion or rolling, if appropriate further processing, for example by cold-forming and/or machining, foaming by heating to a temperature above the decomposition temperature of the expanding agent, preferably in the temperature range of the melting point of the metal used, and subsequent cooling of the body which has been foamed in this way.

Finally, the problem mentioned above is also solved by the use of a powder comprising or containing nucleated particles which bring about a uniform bubble formation and homogeneous foam structure as an addition to a mixture of at least one metal powder which forms a metal matrix and at least one gas-producing expanding agent powder for the production of metal foamed bodies, it being possible for the powder to consist of particles of silicon, silicon carbide, aluminum oxide and/or titanium boride which have a particle size of smaller than 30 $\mu$m. To produce a foamed body from a matrix comprising an aluminum alloy, it is possible to use a powder with uniformly distributed particles of a hypereutectic aluminum-silicon alloy with a fraction of the silicon in the form of primary silicon crystals in attempts have either failed to lead to the desired uniform foam structure or require complex processes, making production more expensive.

When using a fully alloyed powder comprising an aluminum alloy of type AlSi12 or AlSi7Mg with an addition of titanium hydride powder, the foaming behavior was less favorable than when using a powder or a powder mixture of the metal matrix Al or AlMg with an addition of 12% silicon powder or 7% silicon powder. With other matrix alloys of the AlMgSi type, it was also observed that the addition of silicon powders led to an improved foaming behavior. However, the drawback of an uneven foam structure with widely differing pore sizes remained.

Figure 1:
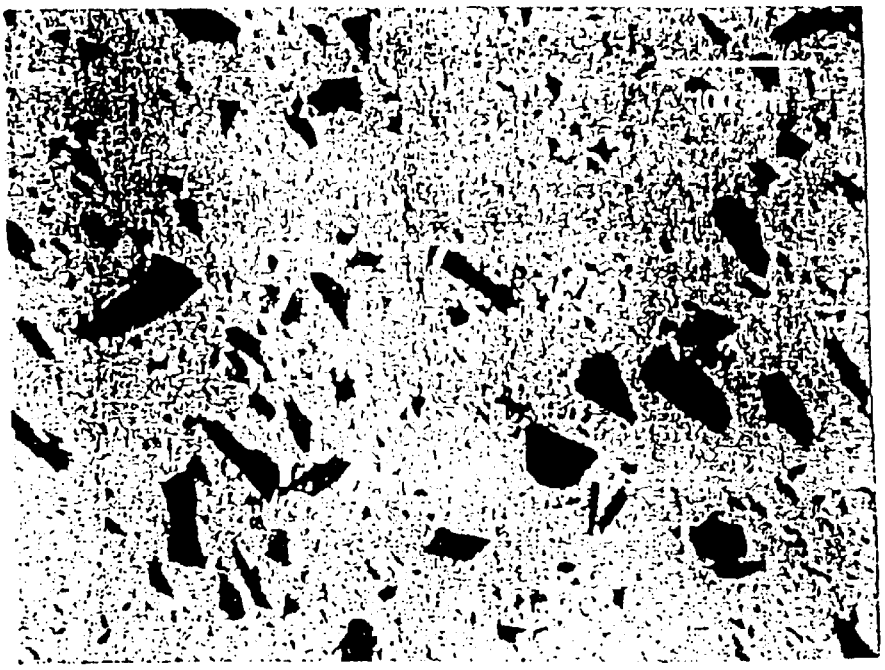
FIGURE 1 PRIOR ART
FIG. 1 shows the microstructure of an alloy having unevenly distributed and irregularly shaped and sized silicon particles in accordance with the prior art.

The uneven foam structure can be ascribed to uneven nucleation for the bubble formation owing to the uneven size and distribution of the silicon particles. The microstructure of an extruded section which was produced from an AlMgSi powder mixture containing 10% silicon powder is shown in FIG. 1. The silicon particles in the matrix microstructure are unevenly distributed, and their shape and size are also highly irregular.

The invention is therefore based on the problem, for the production of a foamable metal alloy, in particular an aluminum alloy, of producing a foam structure which is as uniform as possible, in order to achieve the desired properties, and of achieving the best possible strength properties.

Working on the basis of this problem, the invention proposes a metal alloy comprising a metal matrix with an addition of a powder comprising or containing nucleating particles which bring about a uniform bubble formation and homogeneous foam structure, the metal matrix used preferably being an aluminum alloy and an addition of uniformly distributed silicon, silicon carbide, aluminum oxide and/or titanium boride particles being added for nucleation.

In order to bring about the uniform bubble formation and homogeneous foam structure, the particle size is preferably smaller than 30 $\mu$m.

Small, uniformly distributed silicon particles which are formed when hypereutectic AlSi molten materials with up to about 50% silicon in the individual powder grains are atomized are particularly advantageous (FIG. 2). The production process is described in patent application 198 01 941.6, filed by the same applicant, relating to a wear-resistant aluminum alloy, in particular for the production of cylinder liners.

The microstructure of an extruded section which was produced from an AlMgSi powder mixture with 10% added silicon in the form of the powder grains described above is shown in FIG. 3. The silicon particles are of a uniform size of between about 10–30 $\mu$m and are uniformly distributed in the matrix.

To solve the abovementioned problem, the invention also proposes a process for producing metal foamed bodies comprising the following steps: producing a homogeneous mixture from at least one metal powder which forms a metal matrix, a powder comprising or containing nucleating particles which bring about a uniform bubble formation and homogeneous foam structure, and at least one gas-producing expanding agent powder, placing the mixture into a die, if appropriate compacting under pressure, e.g. by cold or hot isostatic pressing, subsequently hot-forming, e.g. by extrusion or rolling, if appropriate further processing, for example by cold-forming and/or machining, foaming by heating to a temperature above the decomposition temperature of the expanding agent, preferably in the temperature range of the melting point of the metal used, and subsequent cooling of the body which has been foamed in this way.

Finally, the problem mentioned above is also solved by the use of a powder comprising or containing nucleated particles which bring about a uniform bubble formation and homogeneous foam structure as an addition to a mixture of at least one metal powder which forms a metal matrix and at least one gas-producing expanding agent powder for the production of metal foamed bodies, it being possible for the powder to consist of particles of silicon, silicon carbide, aluminum oxide and/or titanium boride which have a particle size of smaller than 30 $\mu$m. To produce a foamed body from a matrix comprising an aluminum alloy, it is possible to use a powder with uniformly distributed particles of a hypereutectic aluminum-silicon alloy with a fraction of the silicon in the form of primary silicon crystals in the particles of the hypereutectic aluminum-silicon alloy of less than 12% by weight, based on the metal alloy.

The very finely distributed particle structure in the addition added as a powder, in particular the very finely distributed silicon structure, is the decisive factor for uniform bubble formation and therefore for a homogeneous foam structure, since the particles in this fine distribution, in particular the primary silicon crystals, act as nucleating agents for the production of bubbles.

The foamable aluminum alloy may, for example, be an aluminum powder alloy containing an expanding agent, for example titanium hydride ($TiH_2$), and a powder of a hypereutectic aluminum-silicon alloy with a fraction of the silicon in the form of primary silicon crystals in the powder of the hypereutectic aluminum-silicon alloy of less than 12% by weight, based on the metal alloy. The mixture is introduced into a die and is compacted under pressure without the expanding agent powder decomposing. The primary material produced in this way can then be hot-pressed or hot-rolled or hot-extruded without foaming taking place. If this semifinished product is heated to up to about 800° C. in order for foaming to take place, the expanded agent releases the included gas, so that the aluminum alloy powder is foamed. If the foaming of the semifinished product is carried out in a die, the foam fills the contour of the die cavity, adopts its shape and, depending on the level of foaming and the nature of the expanding agent addition, has a density of approximately 0.3 to 1.7 g/cm$^3$. The foamed aluminum alloy has closed pores which are substantially the same size and uniformly distributed, is very able to withstand pressure, has a low weight and imparts the strength which is required for the particular application to the shaped object.

The production of foamed products from an aluminum alloy is mentioned only by way of example. The invention also covers foamed products from any foamable metal to which a powder containing nucleating particles is added in order to achieve uniform bubble formation and a homogeneous foam structure.

What is claimed is:

1. A powder mixture for producing aluminum metal foamed bodies comprising:

a powder comprising an aluminum alloy;

a powder comprising or containing uniformly distributed particles of a hypereutectic aluminum-silicon alloy with a fraction of silicon in the form of primary silicon crystals and less than 20% by weight, based on the total quantity prior to foaming, for serving as nucleating particles which bring about a uniform bubble formation and homogeneous foam structure and have a particle size of smaller than 30 $\mu$m; and a gas-producing expanding agent powder.

2. A process for producing metal foamed bodies from a powder mixture, comprising the steps of:

producing a homogenous mixture from at least one metal powder which forms a metal matrix, a powder comprising or containing uniformly distributed particles of a hypereutectic aluminum-silicon alloy with a fraction of silicon in the form of primary silicon crystals and less than 20% by weight, based on the total quantity prior to foaming, for serving as nucleating particles which bring about a uniform bubble formation and homogeneous foam structure, and at least one gas-producing expanding agent powder;

placing the mixture into a die;

foaming the mixture by heating the mixture to a temperature above the decomposition temperature of the expanding agent to form a foamed body; and cooling the foamed body.

3. The process as claimed in claim 2, further comprising the step of compacting the mixture under pressure in the die.

4. The process as claimed in claim 3, in which the compacting under pressure takes place by cold or hot isostatic pressing.

5. The process as claimed in claim 3, in which the compacting is followed by hot-forming by extrusion or rolling.

6. The process as claimed in claim 5, in which the compacting or the hot-forming, is followed by further processing by cold-forming and/or machining.

7. A method for the production of metal foamed bodies, comprising adding, to a mixture containing at least one metal powder which forms a metal matrix and at least one gas-producing expanding agent powder, a powder containing uniformly distributed particles of a hypereutectic aluminum-silicon alloy with a fraction of silicon in the form of primary silicon crystals and less than 12% by weight, based on the total quantity, the powder which contains uniformly distributed particles of a hypereutectic aluminum-silicon alloy functioning as nucleating particles which bring about a uniform bubble formation and homogeneous foam structure in the production of a foamed body.

8. The method as claimed in claim 2 with a particle size of smaller than 30 $\mu$m.

9. The process as claimed in claim 3, in which the compacting is followed by further processing by cold-formiing and/or machining.

10. The process as claimed in claim 4, in which the compacting is followed by further processing by cold-forming and/or machining.

11. The powder mixture as claimed in claim 1, wherein the powder particles individually comprise up to about 50% silicon.

* * * * *